United States Patent [19]

Weathers

[11] 4,318,109

[45] Mar. 2, 1982

[54] PLANAR ANTENNA WITH TIGHTLY WOUND FOLDED SECTIONS

[76] Inventor: Paul Weathers, c/o T.V. Antenna, Specialists, Inc., 1013 Lake Shore Dr., Collingswood, N.J. 08108

[21] Appl. No.: 903,056

[22] Filed: May 5, 1978

[51] Int. Cl.[3] ..... H01Q 1/38

[52] U.S. Cl. ..... 343/806

[58] Field of Search ..... 343/856, 860, 861, 908, 343/806

[56] References Cited

U.S. PATENT DOCUMENTS

| | | | |
|---|---|---|---|
| 760,463 | 5/1904 | Marconi | 343/908 |
| 2,021,734 | 11/1935 | Macalpine | 343/860 |
| 2,039,988 | 5/1936 | Graves | 343/873 |
| 2,166,750 | 7/1939 | Carter | 343/741 |
| 2,648,001 | 8/1953 | Rowland | 343/741 |
| 2,761,140 | 8/1956 | Ashton | 343/803 |
| 2,780,808 | 2/1957 | Middlemark | 343/806 |
| 2,821,710 | 1/1958 | Hale | 343/806 |
| 2,875,441 | 2/1959 | McGrane | 343/806 |
| 2,990,547 | 6/1961 | McDougal | 343/806 |
| 3,050,730 | 8/1962 | Lamberty | 343/908 |
| 3,167,775 | 1/1965 | Guertler | 343/804 |
| 3,231,894 | 1/1966 | Nagai | 343/806 |
| 3,344,425 | 9/1967 | Webb | 343/895 |
| 3,454,951 | 6/1969 | Patterson et al. | 343/895 |
| 3,465,344 | 9/1969 | Scott et al. | 343/852 |
| 3,465,346 | 9/1969 | Patterson et al. | 343/895 |
| 3,541,475 | 11/1970 | Cance et al. | 333/25 |
| 3,587,105 | 6/1971 | Neilson | 343/806 |
| 3,689,929 | 9/1972 | Moody | 343/802 |
| 3,716,861 | 2/1973 | Root | 343/806 |

FOREIGN PATENT DOCUMENTS 1019717 11/1957 Fed. Rep. of Germany .

*Primary Examiner*—Eli Lieberman

[57] ABSTRACT

A broad-band antenna system capable of receiving VHF, FM, and UHF bands, having highly desirable directional properties, providing sharp nulls for the rejection of unwanted reflections, and with broad directional properties, usually obtainable only with large tunable dipoles or loops, many times the dimensions of this very compact antenna unit. This is strictly a receiving antenna, since it has no radiation capabilities, and consequently minimal loss of received signal due to reradiation.

2 Claims, 6 Drawing Figures

PLANAR ANTENNA WITH TIGHTLY WOUND FOLDED SECTIONS

BACKGROUND OF THE INVENTION

This invention relates to antenna systems for the reception of electromagnetic waves, and more particularly, to compact and effective antenna systems capable of efficiently intercepting VHF or UHF signals of the frequencies used in television and FM radio broadcasting, and transferring them to the input of a signal conversion device. In general, the present invention relates to antenna systems in which the receptor appears to be electrostatically rather than inductively responsive, and is coupled to a low impedance, resistively terminated transmission line.

Numerous antenna configurations have heretofore been proposed, consisting in general of dipoles, loops, or long-wire type devices, and variations or combinations of them. For VHF and UHF reception, various forms of dipoles are today used almost exclusively; loops are also used for VHF as well as often used for direction finders, or in combination with ferrite rods for AM broadcast reception.

Electrostatic antennas, using solid flat plates used for reception of electromagnetic waves, are effective only in that part of the electromagnetic spectrum where the capacity reactance of the solid plate matches the transmission line. These devices have no directional properties and must be dimensioned to the frequency to be received. These devices also exhibit very little radiation when connected as transmitting antennas, and only in this respect, do they resemble this invention. This invention defies the generally accepted theory of reciprocity in antenna systems which says that an antenna must be capable of transmitting as well as receiving to be a good receiving antenna, but tests bear out the fact that the subject of this invention provides reception equal to or superior to dipoles properly tuned and oriented, and does not radiate any appreciable signal when driven as a transmitting antenna.

As is well-known, transmitting antennas radiate a combined field of electric and magnetic energy, and the interchange of energy in the two fields results in a composite field of energy commonly identified as an electromagnetic wave in the far zone (i.e., several wavelengths away from the transmitting antenna). This wave may be visualized as a spherical or isotropic field when radiated in free space from an antenna ideally coupled to the characteristic impedance (120 pi) of free space. At distances comparable to those of a typical TV receiver, the electromagnetic wave front is only a small area segment of the outer boundaries of the isotropic field of energy. Thus, a signal appears to a remote antenna as a plane wave whose electric and magnetic fields are 90° apart and perpendicular in the direction of travel of the wave front.

The design of the dipole and lopp families of antenna is predicated on these known characteristics of electromagnetic wave propagation. Dipoles utilize the energy of both the electric and magnetic fields, so that currents are induced in the antenna elements, and voltage gradients are established as functions of the dimensions of the antenna with respect to the wavelengths of the incident signals.

A dipole is characteristically a basically resonant narrow-band device, with a marked bi-directional pattern. For optimum efficiency, therefore, it must be tuned and accurately directed. Typically, as a result of their electromagnetic properties, receiving dipoles also exhibit substantial reradiation of the incident field with attendant energy loss to their surroundings. Means such as parasitic elements, reflectors and directors are often used with broad-band folded dipoles to provide, to the extent feasible, multiple modes of resonance to cover the desired frequency spectrum, and to recapture reradiated energy resulting from current flow in the antenna elements. The extent of reradiation is a measure of the inefficiency of known dipoles.

In contrast to dipoles, loop antennas are essentially magnetic field receiving devices, the sensitivity of which is a function of area and the number of turns. They must of necessity by physically larger than antennas in accordance with the present invention. Moreover, like dipoles, but unlike antennas in accordance with the present invention, loop antennas suffer significant losses due to reradiation, because they are closed circuits in which current flow is sought to be maximized.

Among the numerous known prior art patents directed to antenna configurations or systems are: U.S. Pat. Nos. 2,039,988, issued May 5, 1936, to Graves, Jr.; 2,166,750, issued July 18, 1939, to Carter; 2,648,001, issued Aug. 4, 1953, to Rowland; 2,761,140, issued Aug. 28, 1956, to Ashton; 2,821,710 issued Jan. 28, 1958, to Hale; 2,990,447 issued June 27, 1961, to McDougal; 3,167,775, issued Jan. 26, 1965, to Guertler; 3,231,894, issued Jan. 25, 1966, to Nagai; 3,344,425, issued Sept. 26, 1967, to Webb; 3,454,951, issued July 8, 1969, to Patterson, et al.; 3,689,929, issued Sept. 5, 1972, to Moody; and 3,716,861, issued Feb. 13, 1973, to Root; and German Pat. No. 1,019,717, issued Nov. 21, 1957, to Kathrein.

Also known are U.S. Pat. Nos. 1,606,775, issued Nov. 16, 1926, to Nyman; 1,875,951, issued Sept. 6, 1932, to Taylor et al; 2,135,037 issued Nov. 1, 1938, to Landon; 2,189,309, issued Feb. 6, 1940, to Carlson et al; 2,218,083, issued Oct. 15, 1940, to Carlson et al; 2,558,339 issued June 25, 1951, to Cohen; 3,013,268 issued Dec. 12, 1961, to Hamel et al; 3,079,602, issued Feb. 26, 1963, to Hamel et al; 3,210,768, issued Oct. 5, 1965, to Hudock, et al; 3,373,533, issued Mar. 12, 1968, to Blaisdell; 3,530,473 issued Sept. 22, 1970, to Ives; 3,820,117, issued June 25, 1974, to Hall et al; 3,971,032, issued July 20, 1976, to Munson et al; 3,984,834 issued Oct. 5, 1976, to Kaloi; 4,040,060, issued Aug. 2, 1977, to Kaloi.

Each of the foregoing patents, among numerous others, relates to a proposed antenna with points of superficial similarity to aspects of the applicant's antenna system, but none discloses the applicant's antenna structure or appears capable of realizing the operative advantages of the present system. For example, although it is suggested in U.S. Pat. No. 3,716,861 that in a loop antenna (which the applicant's is not) "a serptentine configuration" may increase capacitive reactance and radiation resistance, no suggestion is to be found for a configuration like that of the present invention in which reradiation and its attendant losses are minimized. So, too, in the matter of directionality, which, according to the disclosure of that patent is to be controlled by the disposition of the undulations or by the size of the undulations.

The present invention has, therefore, as its principal object, the provision of a compact high efficiency broadband antenna system, the characteristics of which are substantially omni-directional, but which, as will be shown, has a sharp null zone, which may be used to reduce undesired interference levels.

The foregoing and other objects are realized, in a presently preferred form of the invention, by a system which employs a novel complement of a multi-resonant substantially non-reradiating receptor and output matching load coupler and a low VSWR transmission line and signal conversion load coupler.

In a presently preferred form of the invention, the receptor has a plurality of individual segments disposed in a symmetrical array, the segments being wire-like conductive members, sinuous in configuration. The conductors defining the segments and their elements are of small cross-sectional dimension, it having been found that, in general, the smaller the cross-section of the conductors and the more closely they are spaced the more satisfactory the performance of the antenna. Although, consistent with the principles of the invention, the conductors may be wire, or preferably, created by printed circuit techniques, they are sometimes referred herein as "wire-like" to signify their small cross-sectional area, and their tight-folded configuration so as to distinguish them from large self-supporting antenna-forming elements such as tubing or castings.

The electrically symmetrical receptor apparently presents to the sending end of the transmission line via the coupler system a broad-band frequency response and impedance comparable to that of free space, i,e., 120 pi. The sending end of the transmission line in the presently preferred embodiment consists of a series loading coil which is connected to the receptor at the electrical center point of the receptor, and is both electrically and inductively coupled to the low impedance low VSMR transmission line.

Since the present receptor is electrically symmetrical with respect to its feed point, it is relatively insensitive to the magnetic component of the electromagnetic field. Under these conditions a very small RF surface current flows on the receptor, and consequently its low ohmic resistance does not result in a significant reradiation of the field received. Any currents which result from the absorption of the electric field will appear at the common junction point of the two halves of the receptor, in phase relationships which vary with frequency, due to the multi-resonant modes of the interconnecting monopoles, thereby reducing the magnitude of the current flow in the receptor elements and raising its radiation resistance to a point where, it is believed, the receptor becomes essentially a bridging source of energy between the transmission line coupling system and free space.

For the purpose of illustrating the invention, there are shown in the drawings forms of the invention which are presently preferred, it being understood, however, that this invention is not limited to the precise arrangements and instrumentalities shown.

DETAILED DESCRIPTION

Figure 1:
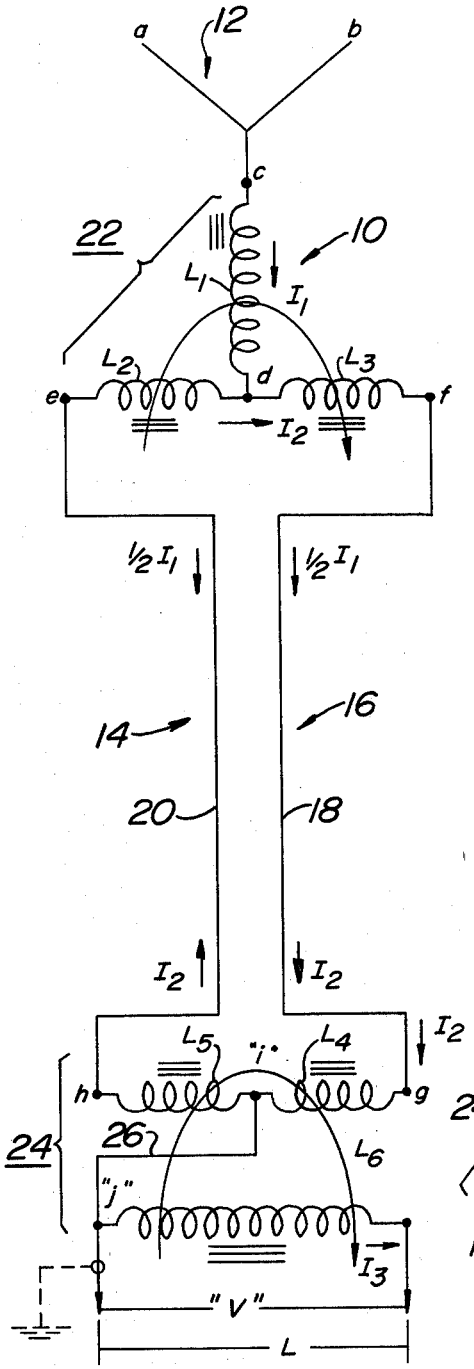
FIG. 1 is a circuit schematic drawing of an antenna system in accordance with the invention, in an embodiment using a conventional 300 ohm twin lead transmission line.

Referring now to the drawings in detail, wherein like numerals indicate like elements, there is seen in FIG. 1 an antenna system designated generally by the reference numeral 10.

The antenna system 10 comprises antenna means, designated generally by the reference numeral 12, in the form of a multi-resonant, substantially non-radiating electrically symmetrical receptor (which will be described in greater detail below); and signal transmission means, designated generally by the reference numeral 14, for coupling the antenna means 12 to a load.

The transmission means 14 in the form of the invention illustrated in FIG. 1 comprises a balanced transmission line 16 of the parallel conductor (300 ohm) type, and having conductors 18 and 20; a coupling transformer designated generally by the reference numeral 22 connected to the antenna means 12 and the transmission line 14; and another coupling transformer, designated generally by the reference numeral 24 connected to the transmission line 16 and an input terminal of a load or driven device (designated by the symbol "L").

The coupling transformer 22 has a primary winding in the form of an inductor $L_1$, which is connected to the antenna means 12 as a loading coil at the electrical center "c" of the antenna means 12. In one presently contemplated form of the invention, the inductor $L_1$ can be made integral with the antenna means 12, as will be explained below.

The secondary winding of the coupling transformer 22 comprises a pair of like-wound series-connected coils or inductors $L_2$ and $L_3$, having equal number of turns, each inductively coupled to the inductor $L_1$. The inductor $L_1$ is also electrically connected to the secondary winding, its finish being connected to the junction "d" of $L_2$ and $L_3$, that junction being, in view of the values of $L_2$ and $L_3$, the electrical center of the secondary winding. In one present form of the coupling transformer 22, the number of turns in the inductor $L_1$ is in the ratio of 2:1 with the number of turns in each of the inductors $L_2$ and $L_3$.

The conductors 18 and 20 of the transmission line 16 are connected, respectively, at their antenna ends to the start "e" and finish "f" of the secondary windings. The other ends of the conductors 18 and 20 are connected, respectively, at junctions "g" and "h" to the primary windings of the coupling transformer 24.

The primary windings of the coupling transformer 24 comprise like-wound series-connected coils or inductors $L_4$ and $L_5$, having equal numbers of turns, and the secondary windings comprise an inductor $L_6$. In one present form of the coupling transformer 24, the number of turns in each of the inductors $L_4$ and $L_5$ is in the ratio of 2:1 with the number of turns in the inductor $L_6$. A conductor 26 connects the electrical center "i" of the primary windings $L_4$, $L_5$ and the finish of inductor $L_6$.

The manner of operation of the antenna system 10 should now be apparent.

The electromagnetic field is intercepted by the antenna means 12, causing a current to flow, the current and voltage being in phase at point "c" and the voltage a maximum at points "a" and "b". The in-phase voltage and current of point "c" (the electrical center of the antenna means 12) produces a resultant current $I_1$ through inductor $L_1$. The current $I_1$ is equally divided at junction "d", half going through $L_2$ and conductor 20 and half through inductor $L_3$ and conductor 18, and remains divided until it reaches the junction "i" of inductors $L_4$ and $L_5$. The preceding conditions obtain, when the antenna is optimally directed toward the transmitting station.

It will be recognized that current $I_1$, meets only one significant impedance, namely, $I_L$, since the equal components of $I_1$, and $L_2$ and $L_3$ produce equal voltages of the same phase at junctions "e" and "f". The point "i", at which the halves of current $I_1$, rejoin, is the electrical center of the primary winding of coupling transformer 24, and is at ground potential, the conductor 26 being connected to the grounded input terminal of the load through point "j". As a result of mutual inductance, the halves of $I_1$ produce equal voltages of opposite phase at points "g" and "h", so no component of current $I_1$ is induced in inductor $L_6$. In signal conversion devices having an unbalanced input, i.e. either input terminal grounded, the finish end of $L_6$, point "j", would be connected to the grounded terminal.

Current $I_1$ does generate, however, by mutual induction, a current $I_2$ which flows in the circuit consisting of inductors $L_2$ and $L_3$, transmission line 16 (conductors 18 and 20), and inductors $L_4$ and $L_5$. The current $I_2$ induces by coupling between inductors $L_4$ and $L_5$ a current $I_3$ in inductor $L_6$, thus producing a voltage "v" across the input of the receiver input load.

The advantage of this system is that perfect symmetry occurs from point "c" to point "i", resulting in a minimum reactive transmission line with a minimum VSWR and broad band resistive termination.

In the presently contemplated best mode of carrying out the present invention, the inductors $L_1$, $L_2$ and $L_3$ are wound from equal lengths of very fine wire, twisted together approximately 15 turns per inch to interwind them with approximately 15 twists per inch and tightly wound into a very small coil with the start of $L_2$ and the finish of $L_3$ forming the above-mentioned junction at "d". The finish of $L_1$ is also terminated at "d".

The impedance of $L_1$ can be raised as desired by adding a fourth wire, not shown in the drawing, twisted together with the three other wires to form a series aiding coil. When $L_1$ is made up of two wires, the finish of one wire is connected to the start of the second wire and the finish on the second wire is connected to junction "d". When the antenna means 12 has relatively short conductor lengths, the enhanced inductance of the thus-modified inductor $L_1$ produces the higher impedance matching.

Figure 6:
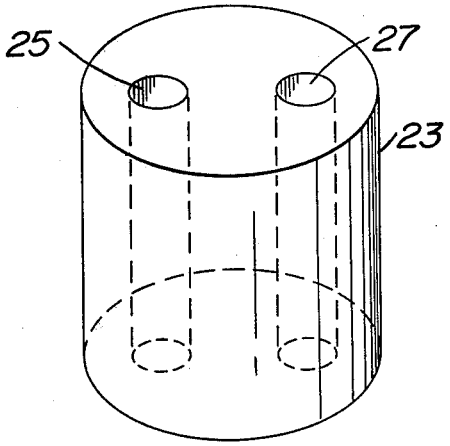
FIG. 6 is a pictorial view of a core upon which the antenna load inductors and transmission line couplers may be wound in accordance with the invention.

Winding of the inductors $L_1$, $L_2$ and $L_3$ on a suitable high permeability core, such as is illustrated in FIG. 6, can reduce the capacitance between turns by reducing the amount of wire needed to attain the desired inductance. This results in a better impedance match at VHF and a more uniform response in the UHF range. In the presently preferred form of the invention, the inductors are simultaneously guadrifilar, trifilar or bifilar wound on the twin hole balun core designated at FIG. 6 by the reference numeral 23, there being approximately one and one-half ($1\frac{1}{2}$) turns in each of the coils, and the transformer having an impedance transformation ratio of 2:1. The core for the coupling transformer 22 in the presently preferred form includes a pair of spaced parallel bores 25 and 27 for receiving the wires forming inductors $L_2$ and $L_3$, and the wires forming inductors $L_1$, $L_2$ and $L_3$ are wound around the core 23. Winding in this manner ensures the desired very tight coupling with minimum leakage reactance between inductors such as $L_2$ and $L_3$ and $L_4$ and $L_5$.

The core material presently preferred is a ferroxide made and sold by Krystinel Corp., of Port Chester, N.Y., and designated "K-405" with a nominal permeability (mu) of 370. In an operative embodiment, the core is 0.001 in. high, 0.141 in. wide and 0.079 in. long, and the bores 25 and 27 are 0.031 in. in diameter. The important properties of the core material for VHF/UHF applications are its permeability and "Q", the product of which will be recognized as a measure of inductive efficiency.

Figure 2:
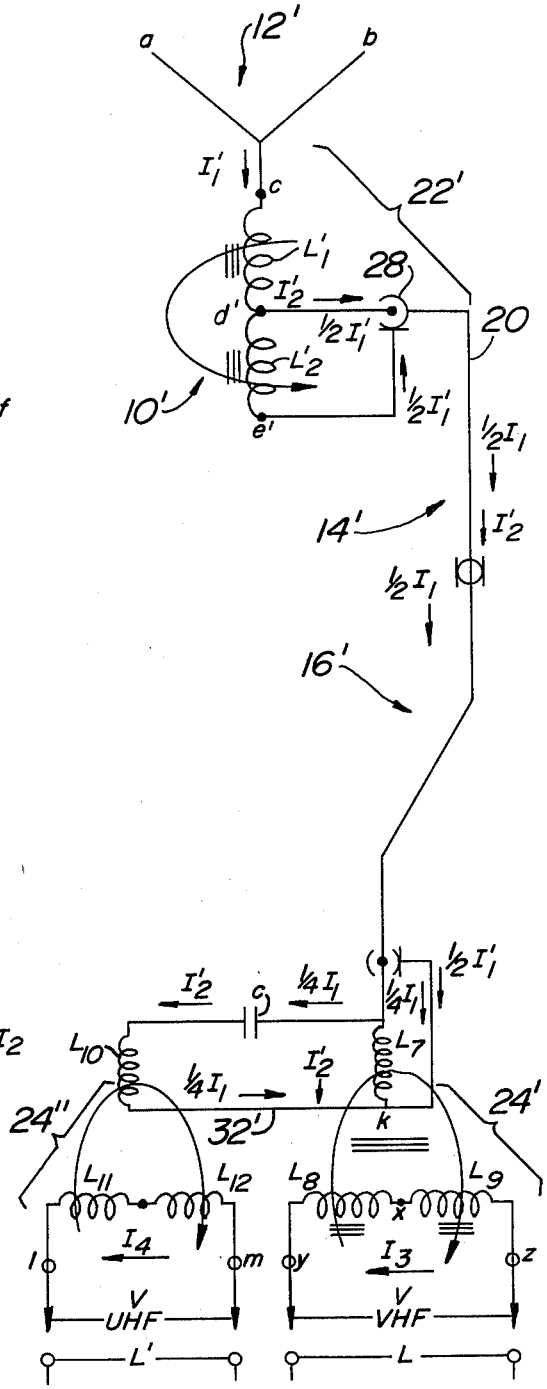
FIG. 2 is a circuit schematic drawing showing a modified form of antenna system in accordance with the invention, in an embodiment using a conventional low impedance coaxial transmission line.

Referring now to FIG. 2, there is seen a modified form of antenna system wherein elements corresponding to those previously described are designated by like, primed reference numerals.

The embodiment of the invention depicted in FIG. 2 utilizes an unbalanced coaxial transmission line 16' (conventionally of 75 ohms though other impedances may be used). Such transmission lines offer some advantages when used with receivers having poor signal balance at their input terminals, of which radiate spurious oscillations which disturb the incident signal on an open line.

The finish of inductor $L_1'$ is connected to the start of inductor $L_2'$ at point "d". The shield 28 of the transmission line 16' is connected to the finish of inductor $L_2'$ at point "e", and the center wire 20 of the transmission line 16' to point "d'". Current $I_2$ induced in inductor $L_2'$ passes through inductor $L_7$ to the transmission line shield 28.

Current $I_1'$ travels directly through inductors $L_1'$ and $L_2'$ to the shield 28 at point "e'" and subsequently to point "k", the common terminal of inductors $L_7$ and $L_{10}$, which are inductively coupled, respectively, to windings $L_8$, $L_9$, $L_{11}$ and $L_{12}$ of the coupling transformers 24' and 24'', the windings comprising like-wound inductors of equal value. No current will be induced in inductor $L_8$ and inductor $L_9$ except that which results from mutual magnetic coupling between inductor $L_7$ and $L_8$ and $L_9$. Undesired EMF's which are coupled capactively to the transmission line 16' are balanced out at points "y" and "z", via mutual capacitances, and only the current $I_3$ will produce a signal, that signal having voltages of opposite phase at points "y" and "z" at the VHF input to the receiver.

The coaxial line can be connected directly to receivers having a low impedance input. Coils in the above-described matrices can be wound either as air core or on materials which enhance the permeability of the field around the coil and consequently reduce the size and number of turns. The air core coil is preferred for the UHF band of channels.

The capacitor "C", and inductors $L_{10}$, $L_{11}$ and $L_{12}$ in FIG. 2 comprises a high-pass balun air core coupler, for matching the coaxial line transmission line 16' to the 300 ohm UHF input. It, per se, is not considered part of the present invention.

The presently preferred turns ratio for the VHF coupler is $6\frac{1}{2}$:2:3, and for the UHF coupler 6:3.

Figure 3:
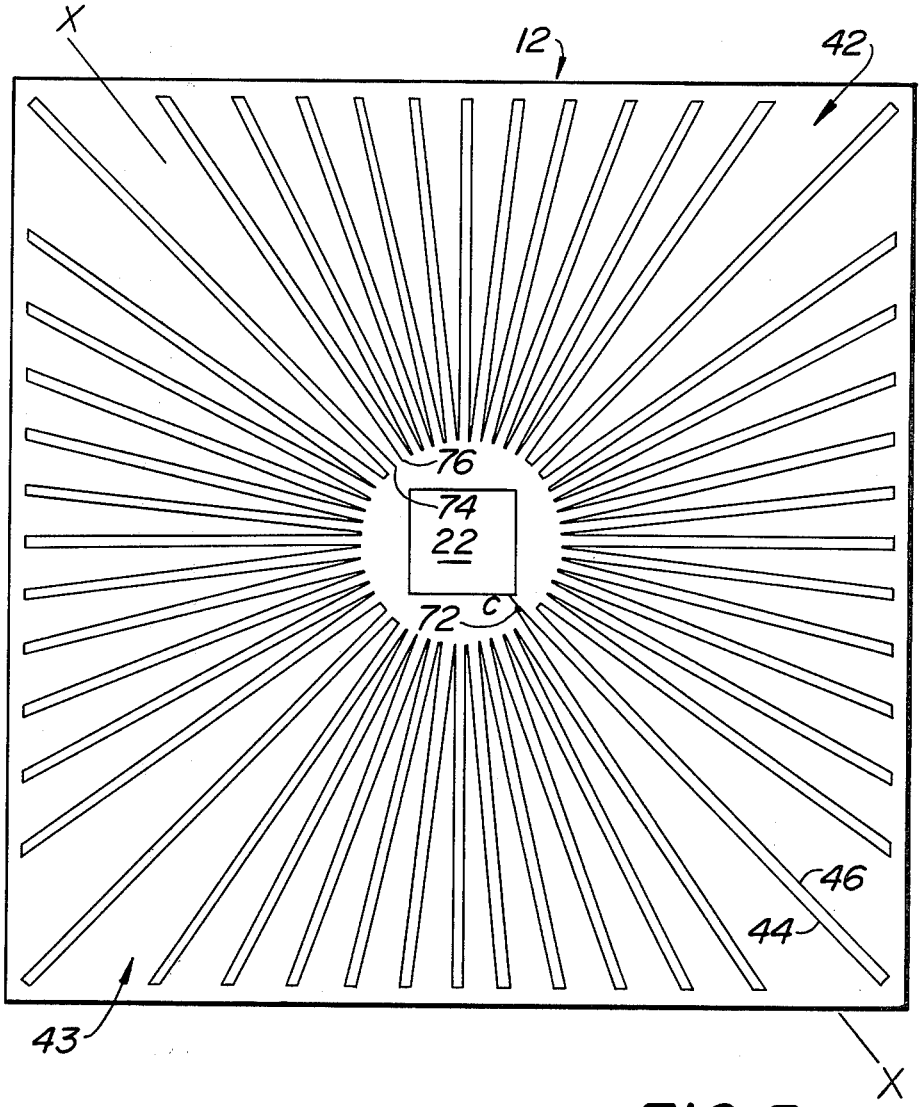
FIG. 3 is a plan view, in approximately full scale, illustrating an embodiment of an antenna means or receptor for use in an antenna system in accordance with the present invention.
Figure 4:
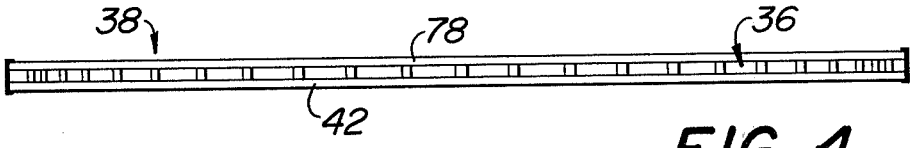
FIG. 4 is a side elevation view of the embodiment of FIG. 3, depicting somewhat diagrammatically (not to scale) the relationship between the segments and the substrate on which they are supported.
Figure 5:
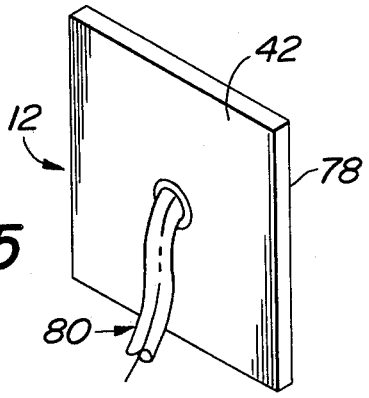
FIG. 5 is a pictorial view of an antenna means or receptor in accordance with the invention.

Referring now to FIGS. 3 to 5, an antenna means or receptor 12 for use in the present antenna system 10 will be described in detail.

The illustrated antenna means 12 comprises segments of conductors of copper or other suitable material of small cross-sectional area, disposed on a dielectric circuit board or substrate 42 of laminated glass-epoxy or other electrically and mechanically satisfactory composition. The segments may be placed on the board 42 using conventional printed circuit techniques. As an alternative, the segments 44, 46 may be formed from small-diameter wire, glued or otherwise secured to the board 42. Other suitable conductors may occur to those skilled in the art.

It has been found that the performance of the receptor 12 is enhanced by having the size of the conductors 44, 46 as small as possible. Thus, in the case of an etched conductor in one present embodiment of the invention, a conductor having a width of about 0.015 to 0.020 inches and a thickness of two mils, for a cross-sectional area of about 3.0 to $4.0\times10^{-5}$ square inches, is highly satisfactory. In the case of wire, No. 36 gauge (approximately 0.005 diameter) has been found satisfactory. Manufacturing considerations and the need for durability dictate the practical lower limit for size of the conductors.

The conductors as laid out on the board 42 have a sinuous shape, which may be visualized as being formed by the series connection of a plurality of individual folded monopole elements having pairs of closely spaced conductors 44 and 46. In the illustrated embodiment, the elements 44 and 46 extend outwardly from or inwardly toward the center of the board 42, parallel to a line radiating from the center "c", and, hence, may be said to extend generally radially. In the illustrated embodiment the conductors 44 and 46 defining the "pair" are interconnected in series at their respective outer ends, and thus form an elongated generally U-shaped element, opening inwardly toward the center of the board 42. The conductors 44 and 46 and the respective conductors of the other pairs are closely coupled physically, in one presently useful embodiment being spaced by about 0.010 inches, and in an operative sense are sufficiently closely coupled to be subjected simultaneously to substantially the same electric gradient of the signal, but delayed in phase as determined by the orientation of the assembly with respect to the wave front of an electromagnetic wave. The pairs of conductors in the illustrated embodiment are substantially uniformly distributed around the board 42.

It is believed that the current produced by the electric gradient flows around the monopolar loop with the phase relation determined by the direction the wave front is moving, the angle of incidence and the spacing between the conductors, with resultant resonant impedance variation in the conductors as a function of the frequency of the intercepted electric field. Thus, the segments are believed to provide, in effect, an almost infinite number of resonant elements responsive to a wide range of frequencies. This can be demonstrated by nodal points of RF "hot spots" on the face of the antenna. Signals which are induced in the looped conductors of receptor 12 automatically produce a pattern of high and low impedance reflection points on the conductors due to the very close spacing of the conductors in the folded segments and their series aiding interconnection. The multi-phased currents in the pairs of conductors 44, 46 appear to minimize magnetic effects, and the observed result is a broadly tuned electrostatic effect with a passband of the desired 50 to about 900 MHz. The respective pairs of conductors are cophased connected around the inner periphery of the array, thus enhancing the useable electrostatic field without reradiating any significant part of the energy intercepted.

The evident efficiency of the receptor 12 is believed to be a result of the low level of reradiation as compared to that characteristic of the basic dipole family of antennas, even as aided by the use of parasitic elements. As indicated above, the apparent electromagnetic reception aperture of the present small receptor is comparable to that of a short electric dipole whose aperture is 0.4 db less effective than that of a resonant $\frac{1}{2}\lambda$ dipole, with a consequent improvement in bandwidth.

Comparative tests of the present antenna system 10 with conventional "rabbit ear" dipoles demonstrate sufficient absence of directionality to obviate any need for readjustment or repositioning of the receptor 12 for each channel. Indeed, the present antenna system 10 has been shown in some test environments to be as effective as a standard folded dipole which includes a reflector and a director type outdoor antenna when mounted in a comparable location.

Tests have also shown the present antenna system 10 has no predominant polarity characteristic, i.e. vertical or horizontal, although it has been observed that with the receptor 12 in the vertical plane, rotation will demonstrate a dipole bidirectional characteristic when the open end of the array is pointed toward the zenith. Also, with the receptor 12 disposed horizontally, some narrow angle directional effects can be observed in weak signal areas, most noticeably as a phase displacement of the basic color components of television signals. These effects can be reduced by isolating the antenna system 10, a minimum of $\frac{1}{2}$ lambda at the lowest useable frequency, i.e. 50 MHz, from any sizeable metallic surface or any self-resonant pipes, guy-wires or similar conduction elements. The present antenna system 10 may be used for reception of circularly polarized energy, and is responsive to both UHF and VHF signals. Thus, the present antenna system 10 is compatible with current and foreseeable modes of broadcasting, and complies with certain presently proposed Federal Communications Commission Regulations requiring that all TV receivers contain equally effective UHF and VHF antennas.

For those antenna applications in which some directionality is desired, as for example, where it is desired that reflections or "ghosts" be eliminated, the principles of the present invention may be applied to elevated rotating support systems. The omni-directional characteristic provides adequate signal, while permitting the principal null response to be directed toward the source of the delayed signal.

Referring now to FIG. 3, the antenna means or receptor 12 is made up of two segments 42, 43 subtending substantially semi-circular sectors, and made up of twenty-four pairs of conductors 44, 46, substantially uniformly distributed in the sectors. The segments 42 and 43 are series connected and tapped at their electrical center 72, but open circuited at their ends 74 and 76, the ends 74 and 76 being located 180° from the electrical center 72 and coupled to each other only capactively.

It is along the axis "X—X" defined by the tap point (the electrical center 72) and the ends 74 and 76 that the directional characteristic is apparent, there being a sharp null behind the tap point and one or more broad nodes elsewhere, the principal lobe being directed along the radius on which the open ends 74 and 76 lie. Thus, when it is in a field free of multi-resonant objects such as metallic pipes or similar conducting surfaces, the antenna means 12 produces a deep null directional pattern by which the effect of specific undesired signals may be eliminated.

The above-described segments 42 and 43 can be configured with any practical number of elements, the greater the number of elements the smaller the dimensions of the antenna for a given length of conductor. A typical configuration uses a total of forty-eight elements disposed in two segments. This makes possible an efficient antenna only 6" by 6" and 3/16" thick and having a conductor approximately twenty-four feet long. Use of twelve radial elements produces an excellent FM antenna starting at 80 MHz and operating efficiently up through the high VHF range. Other configurations are feasible.

Although the configuration of the antenna means 12 is shown to be radial, there is no particular advantage to having either the central terminus of the segments or the outer periphery of the segments follow either a circular, square or other geometrical shape, as long as the symmetry about the electrical center or tap point 72 is maintained, within $\pm 4°$. In some applications, a square periphery (as shown) might be advantageous, in others an ellipse, or circle could suffice, depending upon the application of manufacturing considerations.

The signal energy captured by the antenna means 12, may be coupled by suitably designed or selected signal transmission means, such as the above-described coupling transformers 22, 22', 24 and 24', to the input of a signal conversion device such as a television set.

It has been found in the antenna systems 10, 10' that undesirable stray coupling effects and the VSWR of the transmission means 14, 14' can be minimized by connecting the transmission means 14 to the center of the antenna means 12. Thus, for example, in the embodiment shown in FIG. 5, the inductors $L_1'$ and $L_2'$ (not shown in FIG. 3) are mounted on the board 42 at the center of the array of conductors, and the shield 28 of the transmission line 16' is anchored to the board 42 in electrical contact with inductor $L_2'$.

The antenna means 12 may in final assembly be protected from moisture and impact by sealing with a cover member or plate 78. Receptors can also be equipped with a collar, not shown, to adapt them for outdoor mounting on a standard tubular antenna support mast. If used indoors, antenna means 12 can be supplied with leads 80, seen in FIG. 5, laid in the Figure flat against their surfaces and allowing them to be placed inside picture frames or hidden behind drapes in locations which provide optimum reception of the available signal. In such an assembly, at least the receptor-to-transmission line coupling transformer 22 may be supplied in the sealed unit containing the receptor 12.

The present invention may be embodied in other specific forms without departing from its spirit or essential attributes, and accordingly, reference should be made to the appended claims, rather than to the foregoing specification, as indicating the scope of the invention.

I claim:

1. A broad-band receiving antenna system comprising antenna means and transmission means for coupling said antenna means to a load, said antenna means comprising a multi-resonant, substantially non-radiating, electrically symmetrical receptor responsive to signals in the VHF and UHF broadcast bands, said receptor comprising:

(a) A pair of radially disposed elements comprising a plurality of series connected tightly folded conductive members disposed in a circular array about a common center, each of said folded conductive members comprising a pair of parallel conductors having first ends spaced from one another by not more than 0.02 inches, means electrically connecting the ends of said parallel conductors opposite said first ends and, (b) conductive means for electrically connecting each folded conductive member to an adjacent folded conductive member.

(c) said pair of radially disposed elements disposed on a nonconductive base and, (d) coupling means for electrically connecting said radially disposed elements to said transmission means.

2. A broad-band directional receptor recited in claim 1 wherein said coupling means comprises an impedance matching device, the input of which is connected to the zero current point which is the electrical junction of the two folded conductive members, the output of said matching device being connected to a transmission line.

* * * * *